US006305309B1

(12) United States Patent
Ead et al.

(10) Patent No.: US 6,305,309 B1
(45) Date of Patent: Oct. 23, 2001

(54) ATTITUDE AND ROLL STABILIZER FOR TOWED UNDERSEA DEVICES

(75) Inventors: Richard M. Ead, Wakefield; Robert L. Pendleton, Portsmouth, both of RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/556,362

(22) Filed: Apr. 24, 2000

(51) Int. Cl.[7] ..... B63G 8/14; B63B 21/56

(52) U.S. Cl. ..... 114/245; 114/242

(58) Field of Search ..... 114/244, 245; 43/42.02, 42.22, 43.13, 43.14

(56) References Cited

U.S. PATENT DOCUMENTS 2,729,910 * 1/1956 Fryklund ..... 43/9.7
2,825,994 * 3/1958 Bruhn ..... 43/43.13
3,372,666 * 3/1968 Baker ..... 114/245
3,453,980 * 7/1969 Shock ..... 114/245
4,220,109 * 9/1980 Cholet ..... 114/245

FOREIGN PATENT DOCUMENTS

1266466 * 6/1961 (FR) ..... 114/244

* cited by examiner

*Primary Examiner*—S. Joseph Morano
*Assistant Examiner*—Andrew Wright
(74) *Attorney, Agent, or Firm*—Michael J. McGowan; Robert W. Gauthier; Prithvi C. Lall

(57) ABSTRACT

An attitude and roll stabilizer for towed undersea vehicles includes a vertical joining rod having an upper end and a lower end, a roll control weight mounted to the lower end of the vertical joining rod, an attitude control surface mounted to the upper end of the vertical joining rod, a tow rod pivotally mounted transverse to the vertical joining rod, an actuator member connected to the vertical joining rod between the tow rod and the roll control weight, and a connecting bar connecting the actuator adjacent to the aft end of the tow rod. A change in tow speed of the towed vehicle selectively pivots the tow rod about the vertical joining rod, and is correspondingly compensated for with a counteractive pitching of the attitude control surface and the roll control weight, thereby maintaining the level of the towed vehicle at the altered speed.

16 Claims, 4 Drawing Sheets

ATTITUDE AND ROLL STABILIZER FOR TOWED UNDERSEA DEVICES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to an attitude and roll stabilizer for towed undersea devices. More particularly, the invention relates to an attitude and roll stabilizer for towed undersea devices in which the undersea devices may be towed at varying speeds.

(2) Description of the Prior Art

The current art for attitude and roll stabilization of underwater vehicles has not in the past been directed to towing of the underwater device at varying speeds while controlling roll and pitch in an economical manner. Thus, a problem exists in the art whereby there is a need to control the roll and pitch of underwater vehicles being towed at varying speeds. The following patents, for example, disclose various types of deflectors for underwater vehicle control, but do not disclose a complete similarity with either the hardware or function of the attitude and roll stabilizer for towed undersea devices as set forth in connection with the disclosure of the present invention.

U.S. Pat. No. 5,357,892 to Vatne et al.;

U.S. Pat. No. 4,991,534 to Warman et al.;

U.S. Pat. No. 4,843,996 to Darche; and

U.S. Pat. No. 3,460,384 to Fohl.

Vatne et al. disclose a deflector for installation in the tow line between a towing vessel and a tow which is located in the water. A cable with seismic sources, or a seismic source array, is suspended by a float and has a fitting therefrom having a tow-point near the front part of the deflector connected to the tow line, and an attachment point to the rear of the deflector-for further connection thereto for the rear part of the tow line connected to the two. In order to be able to locate the deflector in a desired position in relation to the towing vessel and compensate for alternations in the effects of forces from the tow or vessel in addition to movements in the water, the tow line which leads on to the actual tow from the deflector body is attached to the deflector via a pivotable lever which is situated at the same height as the lifting force center of the deflector body. The tow point of the tow line body is provided at one lateral surface of the deflector body in front of the vertical center line thereof. An additional deflector wing may be incorporated in the rear part of the tow line. Accordingly, Vatne et al. describe a deflective device with the primary function of avoiding towing an object or different types of equipment directly behind the towing vessel. This device is very different in both hardware and function and, unlike the attitude and roll stabilizer for towed undersea devices of the present invention, it appears to be limited to shallow depth applications. Also, unlike the attitude and roll stabilizer for towed undersea devices according to the present invention, this prior art has no opportunity for electronic control.

The patent to Warman et al. discloses a depressor designed to keep a fish, towed by a ship, submerged and includes a flat swept wing joined to the towing cable by means of three suspenders making it possible to set it as an optimal angle of incidence. This enables a fish to be towed at a high speed which may go up to 30 knots while, at the same time, keeping it at a substantially constant depth of submersion. Accordingly, the device of Warman et al. is very different in both design and function and, unlike the attitude and roll stabilizer for towed undersea devices, does not provide roll stability to the towed device. Also, there is no electronic control capability.

The patent to Darche discloses a system, which is of the type comprising at the end of a primary cable, a first fish to which is connected a secondary cable towed by a second fish. There are provided, in proximity to the first fish, apparatus for measuring the angle between the direction of the relative current and the vertical plane passing through the secondary cable, and apparatus for measuring the angle of inclination of the secondary cable to the horizontal, connected to apparatus for automatically steering the second fish so as to bring the angles to predetermined values. Accordingly, Darche is simply directed to a device that maintains depth control of submerged devices that principally deploy forward of the tow surface craft. This device employs a forward and aft fish. The stability of the forward fish is dependent upon a propulsive capability of such forward fish, which derives electronic control from the aft fish. This device is very different in both design and function and, unlike the attitude and roll stabilizer for towed undersea devices according to the present invention, does not couple roll stability to the device under tow.

Fohl describes a mechanical depth-controlling device that is towed by a surface ship. In particular, the depth control device includes an adjustable boundary layer control coating with a liquid contacting surface of the structure. This device is very different in both hardware and function and, unlike the attitude and roll stabilizer for towed undersea devices of the present invention, does not couple roll stability to the device under tow. Furthermore, maintaining depth with any degree of accuracy appears to be difficult as the speed varies.

Accordingly, this invention is the result of being posed with the problem of using a surface craft to tow an underwater device at varying speeds and to stabilize the device in roll and pitch by the most economical means. This invention replaces the need for a complex and expensive stabilization control system.

It should be understood that the present invention would in fact enhance the functionality of the above patents by providing pitch and roll stabilization for underwater vehicles towed at varying speeds in a manner not previously known in the art.

SUMMARY OF THE INVENTION

Therefore it is an object of this invention to provide an attitude and roll stabilizer for underwater vehicles.

Another object of this invention is to provide an attitude and roll stabilizer for underwater vehicles which is applicable to vehicles being towed at varying speeds.

Still another object of this invention is to provide an attitude and roll stabilizer for underwater vehicles which is an active attitude and roll stabilizer.

A still further object of the invention is to provide an attitude and roll stabilizer for underwater vehicles which is a passive attitude and roll stabilizer.

Yet another object of this invention is to provide an attitude and roll stabilizer for towed undersea devices which is simple to manufacture and easy to use.

In accordance with one aspect of this invention, there is provided an attitude and roll stabilizer for towed undersea vehicles which includes a vertical joining rod having an upper end and a lower end, a roll control weight mounted to the lower end of the vertical joining rod, an attitude control surface mounted to the upper end of the vertical joining rod, a tow rod pivotally mounted transverse to the vertical joining rod, an actuator member connected to the vertical joining rod between the tow rod and the roll control weight, and a connecting bar connecting the actuator adjacent to the aft end of the tow rod. A change in tow speed of the towed vehicle selectively pivots the tow rod about the vertical joining rod, and is correspondingly compensated for with a counteractive pitching of the attitude control surface and the roll control weight, thereby leveling the towed vehicle at the altered speed.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

In general, the present invention is directed to an attitude and roll stabilization device for a towed undersea vehicle.

By way of explanation, the principle advantages of the following disclosure in connection with the inventive attitude and roll stabilizer of the present invention are simplicity and cost. The stabilizer has a broad range of applications for both military and commercial use. Also, the stabilizer can be configured to operate either passively or actively for attitude stabilization.

Figure 1:
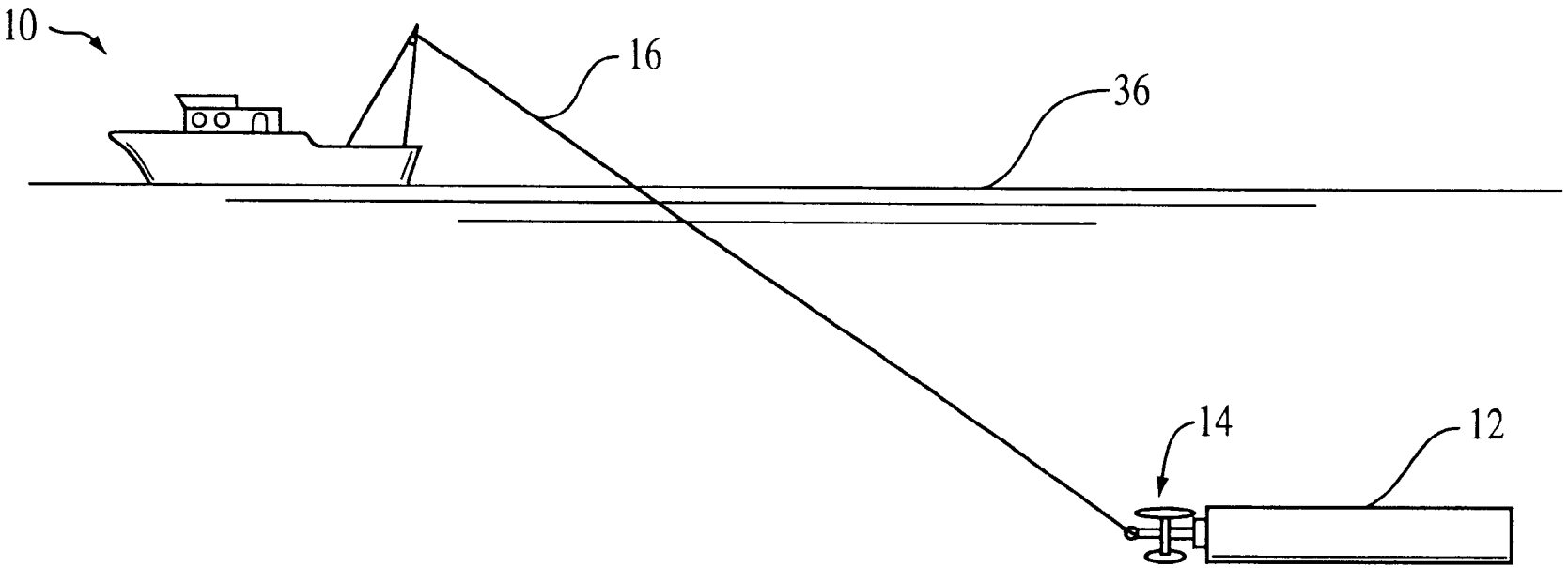
FIG. 1 is a side plan view of a first preferred embodiment of the present invention having an active attitude and roll stabilizer for a towed undersea vehicle.
Figure 2:
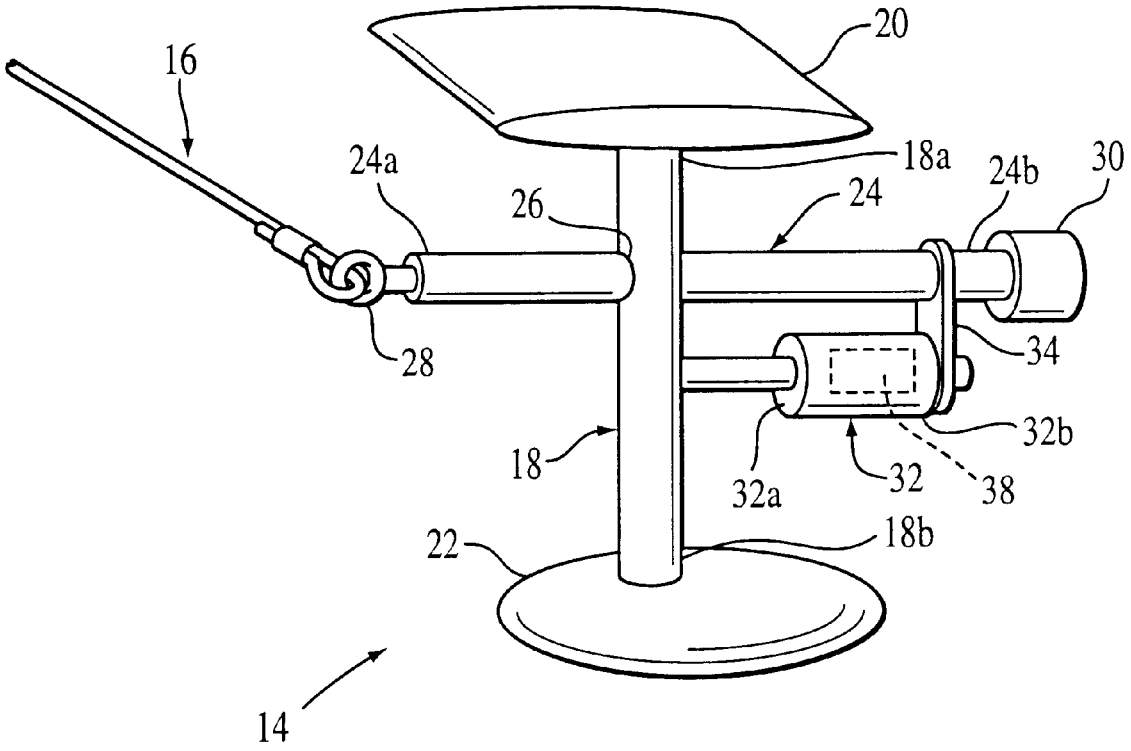
FIG. 2 is a side detailed view of the attitude and roll stabilizer per se of FIG. 1.

Referring first to FIGS. 1 and 2, there is shown an active attitude and roll stabilizer for a towed unmanned undersea vehicle with FIG. 1 illustrating the entire system and FIG. 2 illustrating the stabilizer per se. For the purposes of description and reference to the various parts of the figures, the towing vehicle is identified by reference number 10 and the towed vehicle is at 12. An inventive stabilizer 14 is connected to the towed vehicle 12 and a tow cable 16 connects a fore end of the stabilizer 14 to an aft end of the towing vehicle 10. It should be understood that towing occurs in the direction of the fore end of the towing vehicle 10.

Turning now to the detail of FIG. 2, the details of the stabilizer 14 are shown. In particular, the stabilizer of FIG. 2 is an active attitude and roll stabilizer for towed undersea vehicles 12. As shown, the undersea vehicle 12 is unmanned, but may be manned according to environment and necessity. The stabilizer is constructed of a vertical joining rod 18 having an upper end 18*a* and a lower end 18*b*. At the upper end 18*a* of the stabilizer 18 is mounted an attitude control surface 20 formed in the shape of a foil. At the lower end 18*b* of the stabilizer 18 is a roll control weight 22. Roll compensation is achieved by the roll control weight 22 being located below the unmanned undersea vehicle's 12 center of buoyancy and center of gravity.

Approximately one-third of the distance from the upper end 18*a* to the lower end 18*b* of the vertical joining rod 18 is a transverse tow rod 24. The tow rod 24 is connected to the vertical joining rod 18 by a known connection 26 such as a bolt or the like which permits pivoting of the tow rod 24 with respect to the vertical joining rod 18. A tow eye 28 is connected to a fore end 24*a* of the tow rod 24. The tow eye 28 may be connected in a fixed manner by any suitable means such as welding or the like to the fore end 24*a* of the tow rod 24. The tow cable 16 is looped through or connected to the tow eye 28 and connects to the towing vehicle in any suitable manner as described above.

At an aft end 24*b* of the tow rod 24, a connector 30 is provided which connects the tow rod 24 and hence the stabilizer 14 to the towed vehicle 12. The connector 30 may include an opening for a separate tow cable or may otherwise be securely fixed to the towed vehicle 12. In any event the connection of the connector 30 to the towed vehicle 12 should be strain free so that the towed vehicle 12 is easily attached and detached, perhaps while in an underwater environment.

Below the tow rod 24 and on the vertical joining rod 18, there is mounted an actuator member 32. The actuator member 32 includes a fore end 32*a* and an aft end 32*b*. The actuator member is pivotally connected at the fore end 32*a* thereof to the vertical joining rod 18. The actuator 32 is connected to the tow rod 24 by a connecting bar 34 spanning the distance from the actuator 32 aft end 32*b* to the tow rod 24. More specifically, the actuator 32 is electrically driven such that the actuator 32 automatically compensates for deviation of the stabilizer 14 from a programmed depth or from a distance from the bottom surface (not shown) of the body of water 36. As a tow speed of the towed vehicle 12 increases, an upward force on the tow eye 28 will cause the towed vehicle 12 to climb, resulting in a variance from the programmed depth as described. A depth sensor. and controller 38 incorporated into the actuator 32 will respond by sending an appropriate signal voltage to the actuator 32. In the event that the speed increases, causing a rise in the towed vehicle, the actuator 32 pulls on the vertical joining rod 18 causing the attitude control surface 20 to pitch forward resulting in a downward deflection force of the entire stabilizer 14. With the attitude control surface 20 pitching forward as tow speed is increasing and thereby increasing the downward deflection force of the stabilizer 14, a compensation of the increasing upward force at the tow eye 28 occurs.

It should be noted that the depth sensor and depth controller can be located in the unmanned undersea vehicle 12.

Also, power for the actuator 32 and the depth sensor and controller 38 can be provided either from the unmanned undersea vehicle 12 or from the towing vehicle 10 via the tow cable 16.

The stabilizer 14 is configured to match the requirements for the towing vehicle 10, the towed vehicle 12 and the tow speed.

In particular, the roll control weight 22 is appropriately sized to the towed vehicle 12 to achieve the desired roll stability. Also, the attitude control plane 20 is appropriately sized to the towed vehicle 12 to achieve the desired attitude control. Furthermore, the location of the pivot point 26 on the vertical joining rod 18 and the length of the vertical joining rod 18 are appropriately sized to the towed vehicle 12 to achieve desired attitude control. In addition the attitude control plane's 20 shape is tailored to the buoyancy of the towed vehicle 12. Possible configurations of the attitude and roll stabilizer 20 are shown in further detail in FIGS. 5A–5C and are applicable to either of the disclosed embodiments. This would include shapes such as a foil in FIG. 5A and the embodiments of FIGS. 2 and 4, a wing in FIG. 5B, or an inverted wing in FIG. 5C depending on whether the towed vehicle is neutrally buoyant, negatively buoyant, or positively buoyant, respectively.

Turning now to the second embodiment shown in FIGS. 3 and 4, a passive attitude and roll stabilizer will be described. In general, the basic components of the passive attitude and roll stabilizer are the same as that shown in FIG. 1, but will be described with separate reference numerals to differentiate from the first embodiment.

Figure 3:
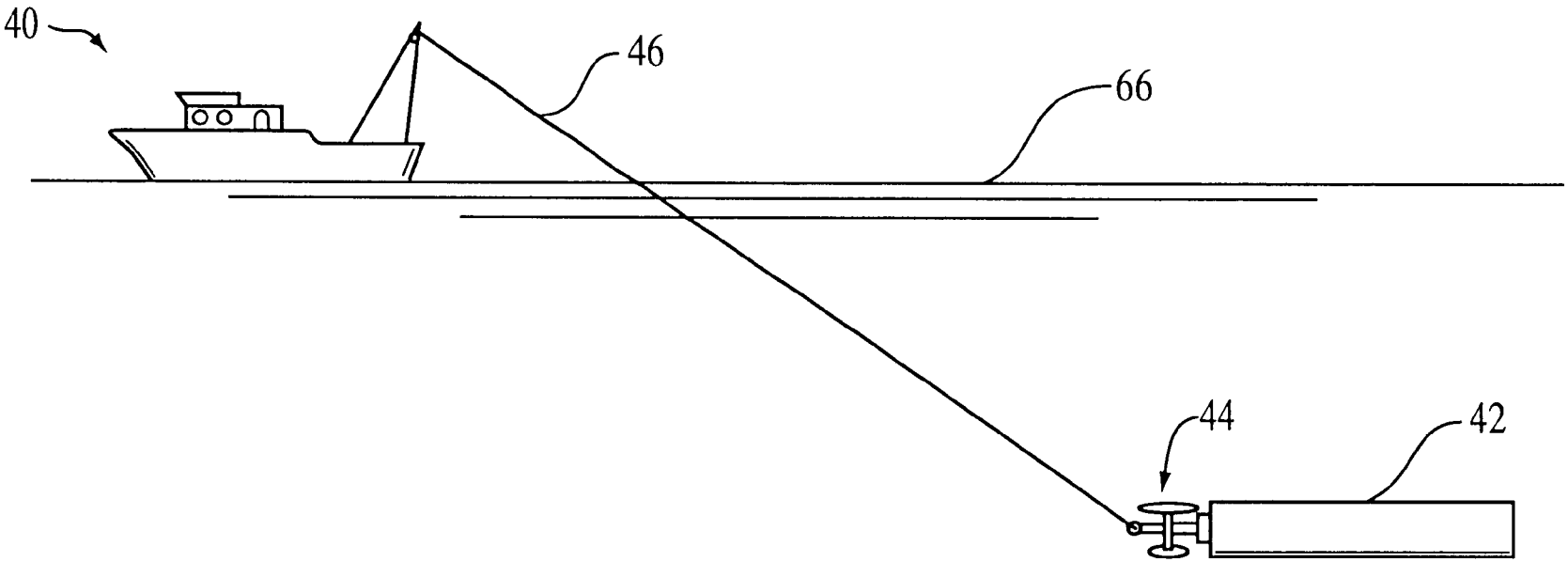
FIG. 3 is a side plan view of a second preferred embodiment of the present invention having a passive attitude and roll stabilizer for a towed undersea vehicle.
Figure 4:
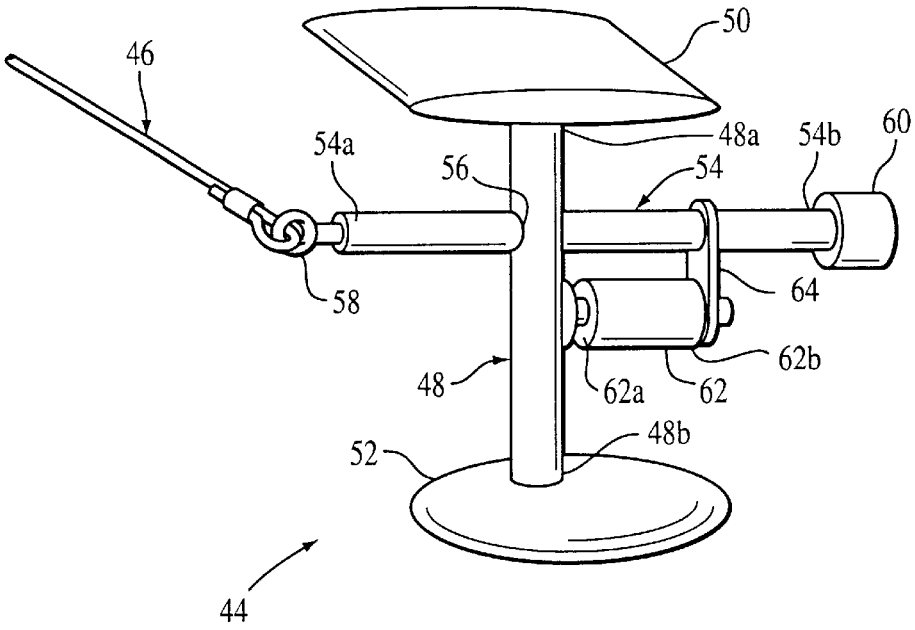
FIG. 4 is a detailed side view of the attitude and roll stabilizer per se of FIG. 3.
Figure 5A:
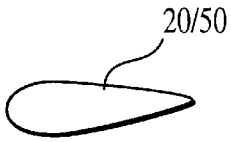
FIGS. 5A, 5B, and 5C are side views of wing shapes for use in connection with either the first or second embodiments of the present invention.
Figure 5B:
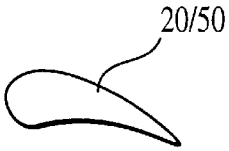
Figure 5C:
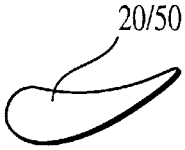

Referring to FIGS. 3 and 4, there is shown a passive attitude and roll stabilizer for a towed unmanned undersea vehicle with FIG. 3 illustrating the entire system and FIG. 4 illustrating the stabilizer per se. For the purposes of description and reference to the various parts of the figures, the towing vehicle is identified by reference number 40 and the towed vehicle is at 42. An inventive stabilizer 44 is connected to the towed vehicle 42 and a tow cable 46 connects a fore end of the stabilizer 44 to an aft end of the towing vehicle 40. It should be understood that towing occurs in the direction of the fore end of the towing vehicle 40 through the water 66.

Turning now to the detail of FIG. 4, the details of the stabilizer 44 are shown. In particular, the stabilizer of FIG. 4 is a passive attitude and roll stabilizer for towed undersea vehicles 42. As shown, the undersea vehicle 42 is unmanned, but may be manned according to environment and necessity. The stabilizer 44 is constructed of a vertical joining rod 48 having an upper end 48*a* and a lower end 48*b*. At the upper end 48*a* of the stabilizer 48 is mounted an attitude control surface 50 formed in the shape of a foil. At the lower end 48*b* of the stabilizer 48 is a roll control weight 52. Roll compensation is achieved by the roll control weight 52 being located below the center of buoyancy and center of gravity of the towed vehicle 42.

Approximately one-third of the distance from the upper end 48*a* to the lower end 48*b* of the vertical joining rod 48 is a transverse tow rod 54. The tow rod 54 is connected to the vertical joining rod 48 by a known connection 56 such as a bolt or the like which permits pivoting of the tow rod 54 with respect to the vertical joining rod 48. A tow eye 58 is connected to a fore end 54*a* of the tow rod 54. The tow eye 58 may be connected in a fixed manner by any suitable means such as welding or the like to the fore end 54*a* of the tow rod 54. The tow cable 46 is looped through or connected to the tow eye 58 and connects to the towing vehicle 40 in any suitable manner as described above.

At an aft end 54*b* of the tow rod 54, a connector 60 is provided which connects the tow rod 54 and hence the stabilizer 44 to the towed vehicle 42. The connector 60 may include an opening for a separate tow cable or may otherwise be securely fixed to the towed vehicle 42. In any event, the connection of the connector 60 to the towed vehicle 42 should be strain free so that the towed vehicle 42 is easily attached and detached, perhaps even while in an underwater environment.

Below the tow rod 54 and on the vertical joining rod 48, there is mounted an adjustable spring mechanism 62. The adjustable spring mechanism 62 includes a fore end 62*a* and an aft end 62*b*. The adjustable spring mechanism 62 is fixedly connected at the fore end 62*a* thereof to the vertical joining rod 48. The adjustable spring mechanism 62 is connected to the tow rod 54 by a connecting bar 64 spanning the distance from the aft end 62*b* of the adjustable spring mechanism 62 to the tow rod 54. More specifically, the adjustable spring mechanism 62 is mechanically actuated such that the adjustable spring mechanism 62 will automatically compensate for deviation of the stabilizer 44 from a linear tow path during a towing operation. As a tow speed of the towed vehicle 42 increases, an upward force on the tow eye 58 will cause the towed vehicle 42 to climb resulting in a variance from the linear tow path as described and causing the aft end 54*b* of the tow rod 54 to tilt upward relative to vertical joining rod 48. In the event that tow speed of the towed vehicle 42 increases, causing a rise in the towed vehicle 42, the adjustable spring mechanism 62 pulls on the vertical joining rod 48 causing the attitude control surface 50 to pitch forward resulting in a downward deflection force of the entire stabilizer 44. With the attitude control surface 50 pitching forward as tow speed is increasing and thereby increasing the downward deflection force of the stabilizer 44, a compensation of the increasing upward force at the tow eye 58 occurs.

Thus, for passive operation, as a towed speed of the towed vehicle 42 increases, the upward force at the tow eye 58 is counteracted by a downward force created by the attitude control plane 50.

Once again, the roll control weight is appropriately sized to the towed vehicle 42 to achieve the desired roll stability. Also, the attitude control plane 50 is appropriately sized to the towed vehicle 42 to achieve the desired attitude control. Furthermore, the location of the pivot point 56 on the vertical joining rod 48 and the length of the vertical joining rod 48 are appropriately sized to the towed vehicle 42 to achieve desired attitude control. In addition the shape of the attitude control plane 50 is tailored to the buoyancy of the towed vehicle 42, including the shapes in FIGS. 5A, 5B and 5C as noted previously.

It will be understood that alternatives to the described devices are inherent within the above descriptions. For example, the device can be configured to operate either passively or actively. Furthermore, the roll control weight is appropriately sized to the tow body to achieve the desired roll stability. Also, the attitude control plane is appropriately sized to the tow body to achieve desired attitude control. In addition, the attitude control plane's shape is tailored to the buoyancy of the tow vehicle. This would include shapes such as a foil, a wing, or an inverted wing depending on whether the tow body is neutrally buoyant, negatively buoyant, or positively buoyant, respectively.

The principal advantages are simplicity and costs. The stabilizer has a broad range of applications for both military and commercial use. Also, the stabilizer can be configured to operate either passively or actively for attitude stabilization. Further, it is anticipated that the invention herein will have far reaching applications other than those of underwater vehicles.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

We claim:

1. An attitude and roll stabilizer for towed vehicles, said stabilizer comprising:

a vertical joining rod having an upper end and a lower end;

a roll control weight mounted to the lower end of said vertical joining rod;

an attitude control surface mounted to the upper end of said vertical joining rod, said attitude control surface being substantially parallel to said roll control weight;

a tow rod pivotally mounted transverse to said vertical joining rod, said tow rod having a fore end and an aft end;

a tow eye connected to the fore end of said tow rod;

a vehicle connector mounted to the aft end of said tow rod for connecting said tow rod to said towed vehicle;

an actuator member connected to said vertical joining rod between said tow rod and said roll control weight; and a connecting bar connecting said actuator adjacent to the aft end of said tow rod, wherein a change in tow speed of said towed vehicle selectively pivots said tow rod about said vertical joining rod, and is correspondingly compensated for with a counteractive pitching of said attitude control surface and said roll control weight.

2. The stabilizer according to claim 1 wherein said roll control weight is positioned on the lower end of said vertical joining rod to be located below a center of buoyancy of said towed vehicle.

3. The stabilizer according to claim 1 wherein said roll control weight is positioned on the lower end of said vertical joining rod to be located below a center of gravity of said towed vehicle.

4. The stabilizer according to claim 1 wherein said attitude control surface is shaped as a foil, an underside of said control surface being connected to the upper end of said vertical joining rod.

5. The stabilizer according to claim 1 wherein said attitude control surface is shaped as a wing, an underside of said wing having concave curvature and being connected to the upper end of said vertical joining rod.

6. The stabilizer according to claim 1 wherein said attitude control surface is shaped as an inverted wing, an underside of said inverted wing having convex curvature and being connected to the upper end of said vertical joining rod.

7. The stabilizer according to claim 1 wherein said actuator member is pivotally connected to said vertical joining rod.

8. The stabilizer according to claim 7 wherein said actuator member is electronically actuated and is automatically responsive to a change in predetermined depth of said towed vehicle.

9. The stabilizer according to claim 8 wherein said actuator member responds to a detected change in depth of said towed vehicle by selectively adjusting said vertical joining rod and thereby changing a pitch of said attitude control surface.

10. The stabilizer according to claim 9 wherein a detected upward movement of said towed vehicle is compensated for by forcing said attitude control surface into a downward pitch.

11. The stabilizer according to claim 9 wherein a detected downward movement of said towed vehicle is compensated for by forcing said attitude control surface into an upward pitch.

12. The stabilizer according to claim 1 wherein said actuator member is an adjustable spring mechanism.

13. The stabilizer according to claim 12 wherein said adjustable spring mechanism is automatically responsive to a change in predetermined depth of said towed vehicle resulting from a change in towed speed thereof.

14. The stabilizer according to claim 13 wherein said adjustable spring mechanism responds to a detected change in depth of said towed vehicle by reactively adjusting said vertical joining rod and thereby changing a pitch of said attitude control surface.

15. The stabilizer according to claim 14 wherein an upward movement of said towed vehicle is compensated for by forcing said attitude control surface into a downward pitch.

16. The stabilizer according to claim 14 wherein a downward movement of said towed vehicle is compensated for by forcing said attitude control surface into an upward pitch.

* * * * *